United States Patent [19]

Lewis

[11] 4,320,686

[45] Mar. 23, 1982

[54] WIND INSTRUMENT WITH CONTINUOUSLY VARIABLE PITCH CONTROL

[76] Inventor: Jeffrey J. Lewis, 710 N. Heliotrope, Los Angeles, Calif. 90019

[21] Appl. No.: 106,646

[22] Filed: Dec. 26, 1979

Related U.S. Application Data

[63] Continuation of Ser. No. 926,459, Jul. 20, 1978, abandoned.

[51] Int. Cl.[3] ..... G10D 9/04

[52] U.S. Cl. ..... 84/380 R; 84/330; 84/382; 84/384

[58] Field of Search ..... 84/83, 92, 93, 330, 84/380, 382, 385, 386

[56] References Cited

U.S. PATENT DOCUMENTS

| | | | |
|---|---|---|---|
| 1,395,107 | 10/1921 | Hawk | 84/380 R |
| 1,505,597 | 8/1924 | Mann | 84/385 R |
| 1,556,950 | 10/1925 | Mann et al. | 84/380 R |
| 1,568,460 | 1/1926 | Legler et al. | 84/380 R |
| 1,722,249 | 7/1929 | Lazare et al. | 84/380 R |

FOREIGN PATENT DOCUMENTS

| | | | |
|---|---|---|---|
| 31804 | 6/1927 | France | 84/385 R |
| 631929 | 12/1927 | France | 84/385 R |

OTHER PUBLICATIONS

"The International Musician", Aug. 1924, p. 2.

*Primary Examiner*—Lawrence R. Franklin
*Attorney, Agent, or Firm*—William W. Glenny

[57] ABSTRACT

A wind instrument having a mouthpiece connected to the inner end of a tube forming an elongated resonating chamber, the tube being provided with a slot along virtually its entire length, and an elongated flexible strip closure member having its inner end fixed to the tube adjacent to the mouthpiece and the strip overlying the slot, the outer end of the strip being fixed to the tube structure adjacent to its outer end. Resilient sealing means are provided between the lower face of the strip and the slot walls whereby the closure strip closes the chamber from the mouthpiece end to a selected point where the user digitally depresses the strip into sealing relation with the slot walls, thus creating a resonating chamber of selected length, as determined by the positions of the user's finger. The upper surface of the strip is smooth, permitting the user to produce glissando or bending of notes, and the strip itself is desirably of thin metal, preferably of upwardly concave transverse section to enhance longitudinal stiffness. If the strip is made wider, however, it may be stiff enough that it can be of flat cross-section.

1 Claim, 8 Drawing Figures

WIND INSTRUMENT WITH CONTINUOUSLY VARIABLE PITCH CONTROL

This is a continuation of application Ser. No. 926,459, filed July 20, 1978, now abandoned.

BACKGROUND AND SCOPE OF THE INVENTION

This invention relates generally to wind musical instruments of the type having a mouthpiece and an elongated resonating chamber operatively associated at one end with the mouthpiece, and more particularly to such an instrument wherein the effective length of the chamber, which controls the pitch of a musical note produced by the instrument, is selectively variable by the user continuously over the musical range of the instrument.

As is well known, the family of wind instruments includes the flute, saxophone, bassoon, clarinet, oboe and English horn. Conventional instruments of this family provide a plurality of openings along the length of an elongated resonating chamber associated with the mouthpiece of the instrument, together with means by which the user can selectively close certain openings, in order thereby to adjust the effective length of the resonating chamber. In some instances, as in the case of a flute, the means for closing the openings may be the user's fingers; and in other instruments of the family, mechanical closure means are provided which may be digitally actuated by the user from open to closed positions, or from closed to open positions. In these instruments, the change of pitch from the actuation by the user of adjacent openings is necessarily a discrete change from one pitch to another; it is virtually impossible to produce a glissando or bending of a note in such instruments.

In accordance with the present invention, there is provided an elongated resonating chamber operatively associated with a sound-producing mouthpiece. The effective length of the chamber determines the pitch of the musical note produced by the instrument, as in the case of the conventional instruments referred to above. However, the present invention provides for an infinite or continuous variation of the effective length of the resonating chamber, under the control of the user, so that the instrument is capable of producing a glissando, bending of a note, and the like. In the preferred form of the invention hereinafter illustrated and described hereinafter as applied to a flute, the elongated resonating chamber is provided with a slot extending substantially the entire length of the chamber, together with means by which the user can digitally close as much as may be desired of the length of the slot from its inner end adjacent to the mouthpiece to the selected point of closure of the slot, spaced from the mouthpiece. More particularly, the closure means desirably takes the form of an elongated strip of flexible sheet material such as thin metal, having one of its ends fixed to the body of the instrument at the inner end of the slot adjacent to the mouthpiece, and means are provided at the outer end of the slot and the resonating chamber, by which to normally maintain the major portion of the length of the strip substantially spaced away from the slot, thereby leaving the slot open throughout virtually the entire length of the resonating chamber. In playing the instrument in accordance with the present invention, the user digitally forces the closure strip into sealing relationship with the portions of the elongated chamber marginally adjacent to the slot, and in the preferred form of the invention, there may be resilient means such as sponge rubber or equivalent material, carried by the lower face of the strip, so that the digital actuation of the closure strip into contact with the instrument will create a virtually hermetically tight seal from the inner end of the strip to the point where the user applies downward force.

It is accordingly the principal object of the present invention to disclose and provide a novel musical wind instrument. Another object of the invention is to provide such an instrument having a tube forming an elongated resonating chamber operatively associated with a mouthpiece, the chamber having formed therein an elongated slot throughout substantially all of its length, together with means including a flexible strip by which the user may digitally close the slot from its inner end to any desired point along the length of the strip. Other objects and purposes of the invention are to provide, in such an instrument, resilient means carried by the lower face of the strip whereby to enhance the sealing effectiveness of the closure strip; to provide, in such an instrument, a strip having an upwardly concave transverse section whereby to enhance its longitudinal stiffness; and for other and additional purposes as will become clear from a reading of the following description of a preferred embodiment of the invention, taken in connection with the accompanying drawings.

DETAILED DESCRIPTION

Figures 1, 2, 3, 4, 5, 6, 7, 8:
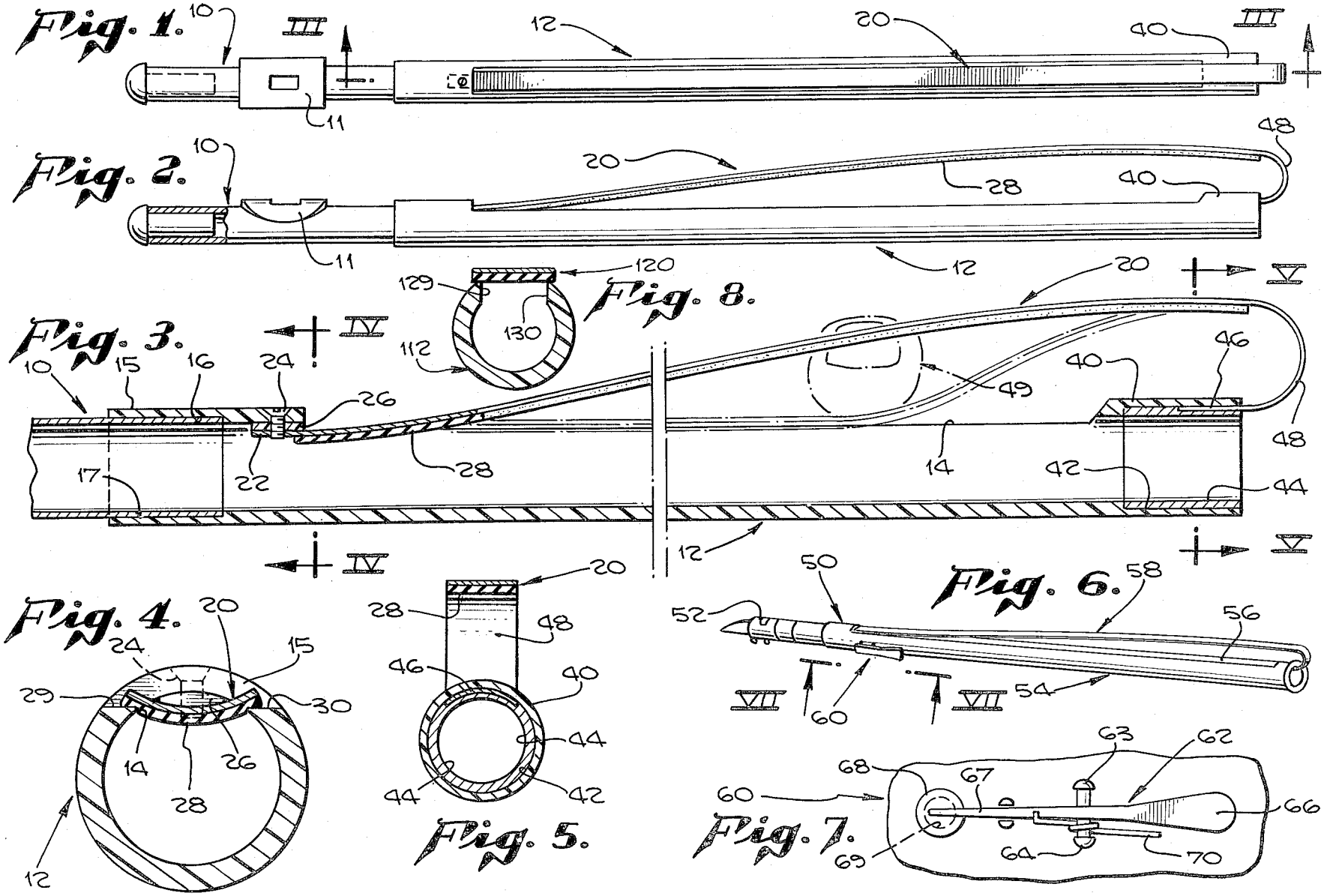
FIG. 1 is a top plan view of a flute embodying the present invention.
FIG. 2 is a side elevational view of the flute of FIG. 1.
FIG. 3 is a fragmentary sectional view, on an enlarged scale, taken on arrows III—III of FIG. 1, showing, in dotted outline, the strip in its position when depressed by the user's finger at a selected point along the tube.
FIGS. 4 and 5 are sectional views taken on arrows IV—IV and V—V respectively of FIG. 3.
FIG. 6 is a perspective view of the present invention incorporated in a clarinet.
FIG. 7 is a fragmentary view taken on the arrows VII—VII of FIG. 6, showing an octave key which may be used compatibly with the present invention.
FIG. 8 is a view similar to FIG. 4 showing a modification to strip 20.

In FIGS. 1 and 2 there is shown a flute embodying a preferred form of the present invention and including a mouthpiece indicated generally at 10 having a conventional lip plate 11 and, operatively associated with the mouthpiece, means forming an elongated resonating chamber in the form of a longitudinally extending tube indicated generally at 12. As best seen in the sectional views of FIGS. 3 and 4, a slot 14 extends along tube 12, preferably in the upper portion thereof when the instrument is held with mouthpiece 10 in its normal position as seen in FIG. 2. Tube 12 includes a non-slotted portion 15 having a counterbore 16 for frictionally receiving the cylindrical end 17 of the mouthpiece.

Means are provided in accordance with the invention for closing slot 14 of tube 12 along a selected length extending from the inner or mouthpiece end of the tube. In the present form of the invention, such means are shown as taking the form of an elongated closure strip indicated generally at 20, desirably made of flexible sheet material such as thin metal. The innermost end 22 of strip 20 is attached to the non-slotted portion 15 of the tube by attachment means here shown as including a self-tapping screw 24 extending through a radial bore in the non-slotted tube portion 15 and a spacer element 26, the lower part of the screw being threaded into strip end portion 22. Strip 20 has a smooth upper surface, and is desirably pre-formed so that it is concave upwardly in transverse section, in order to enhance its longitudinal stiffness, and spacer 26 serves to maintain that concave contour.

Commencing just outwardly of screw 24, the lower convex face of the strip, at least along marginal portions of that face, is provided with a layer 28 of resilient material such as sponge rubber or equivalent substance, adhesively attached to the strip. Layer 28 is thus in contact with the edges 29 and 30 of tube 12 which define slot 14 at and immediately adjacent to the inner end of the slot. As will be later understood, the resilient layer 28 serves also to seal virtually hermetically with the slot edges throughout a selected length of the tube, during playing of the instrument.

At the opposite end of the tube from the mouthpiece, means are provided for supporting the distal end of strip 20 on the distal end of the tube. As seen in the right portions of FIGS. 2 and 3, the distal end of tube 12 includes a non-slotted cylindrical head 40 which may be provided with a counterbore 42 into which a slightly resilient locking ring 44 is tightly received along with the outermost end 46 of the strip. Resilient layer 28 terminates at or slightly outwardly of alignment with the outer end of slot 14, since its function is only to seal the slot when strip 20 is forced downwardly. Thus strip 20 includes a bowed portion 48 extending through approximately 180° of arc above the tube head 40, thereby normally maintaining the major portion of the length of strip 20 spaced above tube 12 and hence with resilient layer 28 out of contact with edges 29 and 30 flanking slot 14. If strip 20 is made wider, it may have sufficient resilience to maintain bowed portion 48 without being curved. Thus, in the FIG. 8 embodiment, strip 120 is shown wider and flat. Tube 112 is also modified because wider strip 120 can reach vertical edges 129 and 130 which are farther apart than the inside of edges 29 and 30 (FIG. 4).

The FIG. 8 arrangement offers advantages over the FIG. 4 one in that flat strip 120 does not interfere with the circular cross section of the tube which would adversely affect sound qualities.

If thinner walled tubing is used, a flat strip may interfere with a circular cross section. Therefore, a collar could be mounted around slot 14 so that strip 120 would contact the collar rather than edges 129 and 130. The collar could be formed during forming of the tube.

Playing of the instrument by the user will now be described in connection with FIG. 3. A user's finger or thumb indicated generally at 49 may be depressed downwardly on the upper smooth surface of closure strip 20 at a selected point along the length of the strip. The resulting musical note, when the user blows on mouthpiece 10, will be of a certain pitch, and it will be noted that the user can slide his thumb or finger 49 toward or away from mouthpiece 10 along strip 20, thereby closing a smaller or greater portion of slot 14 and thus continuously varying the effective length of the resonating chamber formed by the closed portion of tube 12, i.e. the portion of tube 12 between the user's finger 49 and the mouthpiece 10. As earlier noted, the principles of the present invention are applicable to other musical instruments of the wind family, and in FIG. 6 there is shown a clarinet embodying the present invention. Thus a clarinet indicated generally at 50 includes a conventional mouthpiece 52 attached to an elongated tube indicated generally at 54, which is provided throughout almost its entire length with a slot 56, the tube and slot thus corresponding to tube 12 and slot 14 previously described. Similarly, a strip indicated generally at 58 may be identical to strip 20, being concave upwardly in transverse section and having adhesively attached to its lower convex surface a resilient layer for sealing with the side edges of the tube defining slot 56. The ends of strip 58 are attached to tube 54 in the same way as strip 20 is attached to tube 12.

Playing of clarinet 50 is accomplished in substantially the same way as playing of the flute of FIGS. 1–3, i.e. by digital or pollical pressure by the user downwardly on the upper smooth surface of strip 58, and the same glissando and bending effects can be accomplished as previously described in connection with the flute. Clarinet 50 may be provided with an octave key indicated generally at 60 for shifting the pitch of notes produced by the instrument by a musical octave, as is well known in the art. Thus octave key 60, seen in greater detail in FIG. 7, includes an arm indicated generally at 62 extending parallel to the longitudinal axis of the instrument and mounted for pivotal rocking movement by suitable support means 63, 64, about an axis transverse to the length of the instrument. One end 66 of the arm 62 is a finger rest, the other end 67 of arm 62 carrying a closure member 68 which is adapted to selectively close an opening 69 formed in the wall of the instrument. Resilient means including a spring 70 may be provided to maintain the octave key so that the closure member 68 normally closes the opening 69, and the user may open the opening by depressing finger rest 66, all as is well known in the art.

The metal of strip 20 is preferably a spring steel such as a negator spring purchased in a coil and mounted so that bowed portion goes against the coils. Therefore, when strip 20 is depressed, the portion of the strip from the finger toward the mouthpiece tends to seal the slot below the strip.

There is thus provided a musical instrument of the wind family which, as distinguished from the discrete pitch of notes provided by conventional instruments of this family, is capable of providing notes of infinitely or continuously variable pitch over the range of the instrument. It will be understood that modifications and changes from the specific preferred forms of the invention hereinabove shown and described are within the contemplation of the invention, and are intended to be embraced within the scope of the appended claims.

I claim:

1. In a wind instrument, the provision of:

mouthpiece means for producing a sound;

tubular means forming an elongated resonating chamber operatively associated at one end with the mouthpiece means, the effective length of the chamber serving to control the pitch of a musical note produced by the instrument;

means selectively actuable by the user for continuously varying the effective length of the chamber including an elongated slot extending substantially the length of the chamber;

closure means digitally operable by the user for closing the slot from its end adjacent to the mouthpiece means to a selected point spaced toward the other end of the slot, said closure means including a longitudinally extending closure strip of flexible sheet material having one end fixed to the tubular means adjacent to the mouthpiece; and means for resiliently supporting the other end portion of the strip spaced above the outer end of the slot, said supporting means including a segment of said strip adjacent to its distal end and bowed through an arc of 180° with the outermost end of the bowed segment fixed to the outermost end of said tubular means, and the arc of the bowed segment projecting substantially beyond the end of the slot whereby the closure strip can be digitally depressed into slot closing position up to the outermost extent of the slot.

* * * * *